United States Patent [19]

Petts

[11] Patent Number: 4,580,594

[45] Date of Patent: Apr. 8, 1986

[54] VALVE DEVICES

[75] Inventor: Nigel J. Petts, Chorley, England

[73] Assignee: Dobson Park Industries Plc, Nottingham, England

[21] Appl. No.: 682,376

[22] Filed: Dec. 17, 1984

[30] Foreign Application Priority Data

Jan. 5, 1984 [GB] United Kingdom ..... 8400197

[51] Int. Cl.[4] ..... F16K 31/363; F16K 17/36

[52] U.S. Cl. ..... 137/491; 137/489; 91/170 MP; 405/302

[58] Field of Search ..... 137/491, 489; 405/302; 91/170 MP

[56] References Cited

U.S. PATENT DOCUMENTS 2,351,873 6/1944 Parker ..... 137/491
3,987,814 10/1976 Hall ..... 137/469

FOREIGN PATENT DOCUMENTS 2509920 9/1975 Fed. Rep. of Germany ..... 137/491
364671 9/1962 Switzerland ..... 137/431

*Primary Examiner*—Samuel Scott

*Assistant Examiner*—Allen J. Flanigan

*Attorney, Agent, or Firm*—Murray, Whisenhunt and Ferguson

[57] ABSTRACT

A valve device is provided for use in a pressurized hydraulic fluid path, for example the hydraulic path of a hydraulic leg of a mine roof support which is required to yield under two different sets of conditions. The valve device has a port 15 for connection to the pressurized hydraulic fluid path, a bleed valve 25 being arranged to permit hydraulic fluid to bleed from the path at a first rate when the pressure in the path exceeds the first limit, for example to permit the hydraulic leg to collapse at a very slow rate, for example as a mine roof converges. There is also a dump valve 20 arranged to permit hydraulic fluid to flow from the path at a second greater rate, for example if a rock burst occurs. Although the dump valve 20 reacts to high pressure surges of fluid, it does not react to low pressure surges because a non-return valve device 30 traps on one side of the dump valve hydraulic fluid which is at a pressure in the region of the first limit. Thus the dump valve only operates if the pressure on the other side of the dump valve exceeds the first limit.

6 Claims, 1 Drawing Figure

1/1

1/1
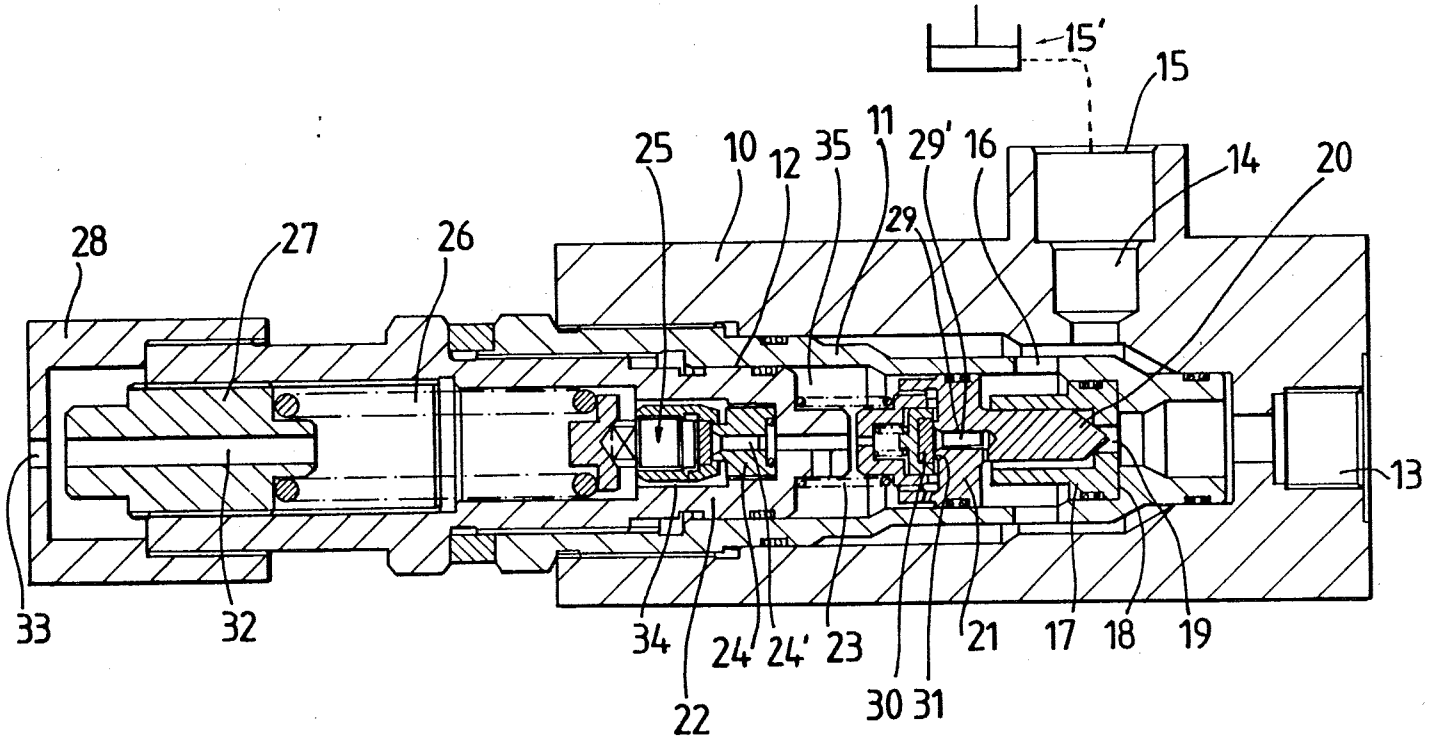

VALVE DEVICES

BACKGROUND TO THE INVENTION

The invention relates to valve devices and particularly to bleed valve devices for use with hydraulic support rams and particularly, but not exclusively, hydraulic rams used as the support legs of a mine roof support.

DESCRIPTION OF THE PRIOR ART

Mine roof supports are well known, comprising a base unit and a roof engaging unit, interconnected by upwardly extending legs in the form of hydraulic rams.

In long wall mining, for example, it is not possible to hold up the mine roof permanently. As the mine face progesses the roof is allowed to converge with the floor behind a row of mine roof supports and the supports are merely required to control the rate or delay the convergence. They must be capable of "giving" slightly and accordingly bleed valve devices are incorporated in the hydraulic paths of the rams so that as the roof pressure builds up on a support and resultant hydraulic pressure builds up in the rams some of the hydraulic fluid within the ram bleeds out to atmosphere allowing the rams to retract at a very slow controlled rate.

For some applications however the rams must also be capable of retracting at a much faster rate under a given high load. This may for example occur during a phenomenon known as rock burst, which is a sudden violent breaking of rock walls stressed beyond their strength limits and possibly accompanied by ground tremors. Rock bursts are hazards in some but not all deep mines whose depths exceed 3000 ft.

One way of providing the required two-stage action is to provide two separate pressure relief valves arranged in parallel, one set to give the required lead in at a given pressure and the other (usually a poppet valve) designed so that under a significantly higher pressure the poppet would lift off its seat and dump the hydraulic fluid from a ram thus allowing the ram to yield rapidly.

With such an arrangement however, the poppet valve and associated equipment must be capable of dealing with pressures at least 10% greater than the bleed pressure. This means that the rating of the equipment has to be increased above normal limits with consequent manufacturing inconvenience and expense.

In another prior device, a dump valve (again usually a poppet valve) is arranged in series with the bleed valve, between the bleed valve and at least one hydraulic ram. The poppet valve is operated by a piston sliding in a cylinder. Pressure from the ram is connected to that side of the piston which tends to open the poppet valve. A spring urges the poppet valve in the closing direction. The bleed valve is connected to that side of the piston which tends to close the poppet valve. The two sides of the piston are interconnected by a flow path containing a narrow orifice.

When pressure surges are very small, as occurs when the ram is yielding, fluid can pass through the orifice and hence reach the bleed valve, which operates normally.

If a rock burst or similar problem occurs, a sudden increase in flow cannot take place through the orifice. There is a pressure surge at that side of the piston which tends to open the poppet valve and this accordingly does open the poppet valve, allowing the hydraulic fluid to be dumped to atmosphere.

This arrangement also suffers from a disadvantage howeve. Since the dump valve piston is responsive, the device is sensitive to low pressure surges, such as may occur when a hydraulic roof support is being moved from one position to another, as well as to high pressure surges. Thus there is frequent unwanted spurting of the dump stage.

OBJECT OF THE INVENTION

It is the object of the invention to provide a valve which is less prone to the above-mentioned problem.

SUMMARY OF THE INVENTION

Accordingly the invention provides a valve device for use in a pressurised hydraulic fluid path, the valve device having a port for connection to the pressurised fluid path, a bleed valve arranged to permit fluid to bleed from the path at a first rate when the pressure in the path exceeds a first limit, a dump valve arranged in series with the bleed valve between the bleed valve and the said port, the dump valve having a bypass circuit which permits fluid to bypass the dump valve so that fluid at a pressure exceeding the first limit can flow at the said first rate past the dump valve to the bleed valve, the dump valve and/or bypass circuit being such that if fluid attempts to flow to the dump valve at a rate greater than the first rate and at a pressure which is not less than the said first limit, the fluid will be dumped, (e.g. to atmosphere).

Preferably the dump valve and bypass circuit prevent fluid from being dumped if fluid attempts to flow to the dump valve at a pressure which is less than the first limit by having a non-return valve which traps a pressure downstream of the dump valve which is in the region of the said first limit.

Preferably the non-return valve is in the bypass circuit.

Preferably the dump valve comprises a valve member and a valve seat and the pressure is trapped against that side of the valve member which is remote from the valve seat so as to hold the valve member on its seat unless the opposite side of the valve member is subjected to an even higher pressure.

The bypass circuit may pass through the valve member of the dump valve, the non-return valve being positioned in the valve member of the dump valve.

The valve device may comprise an elongate valve body, a bore extending through the body from one end to the other, one end of the bore defining a dump port, a transverse passage extending from the said one end of the bore to the exterior of the valve body to define the said port for connection to the pressurised hydraulic fluid path, a dump valve seat lying between the said port and the dump port, a poppet valve member spring-urged on to the valve seat, the poppet valve member having a head which is in sliding sealing engagement within the bore, the side of the head facing the valve seat being in communication with the said port, the bleed valve being mounted in the end of the bore remote from the dump port, defining a pressure chamber between the bleed valve and the other side of the head of the poppet valve member, and a passage through the head of the poppet valve member, such that fluid at a pressure which exceeds the said first limit will pass through the passage in the head of the poppet valve member to bleed away through the bleed valve, and a surge of fluid will tend to lift the poppet valve member off its seat by acting on the side of the head facing the seat, causing the fluid to be dumped through the dump port, and there being a non-return valve in the said passage through the head of the poppet valve member to trap fluid in the pressure chamber at a pressure substantially equal to the said first limit, thus preventing the poppet valve member from reacting to fluid surges which are at a pressure which is less than the said first limit.

The invention includes a hydraulic ram when connected to a valve device as defined above.

The said first rate may be such as to cause the ram to yield at the rate of 2 to 3 (e.g. 2.5) mm per minute.

The dump rate may be such as to cause the ram to yield at the rate of, for example, 0.5 to 1.5 (e.g. 1) meters per second.

The invention includes a mine roof support having at least one hydraulic ram as defined above.

Other objects and advantages of the invention will become apparent from the following description of an embodiment of the invention, given by way of example.

BRIEF DESCRIPTION OF THE DRAWING

The single accompanying FIGURE is a cross-sectional view through a specific embodiment of valve device according to the invention.

DETAILED DESCRIPTION OF THE EMBODIMENT

The valve device shown in the FIGURE comprises an elongate body 10 containing a sleeve 11 which defines a bore 12 extending from one end of the body to the other. The right-hand end of the bore defines a dump port 13. A transverse passage 14 extends through the valve body to define a second port 15 connected to a ram 15'. The passageway 14 communicates with the bore 12 via holes 16 in the sleeve 11.

A dump valve seat 17 is positioned against a shoulder 18. The valve seat 17 has a port 19 therein. A poppet valve member has a tapered valve portion 20 and a head 21. A bleed valve body 22 is fitted within the left-hand end of the bore 12 and a compression spring 23 acting between this body and the head 21 of the poppet valve urges the valve portion 20 of the poppet valve to close the port 19 in the valve seat 17.

The bleed valve itself, which is conventional in design, comprises a valve seat 24 and a valve member 25 which is urged against the valve seat by a compression spring 26, the compression of which can be adjusted by means of a screw-threaded member 27. The member 27 is protected by a cap 28.

The head 21 of the poppet valve has a passage 29 therethrough but mounted in this passage there is a non-return valve device 30. The device 30 comprises a pad which is spring urged against a seat 31 so that the passage 29 is normally closed. As is conventional with valve structures having a non-return valve arrangement, a loosely fitting plug 29' is provided in the passage 29 in order to prevent the non-return value device 30 from being extruded into the passage 29. A similar plug 24' is provided in valve seat 24.

In use the port 15 is connected to the hydraulic fluid within the hydraulic leg of a mine roof support. If the load on the mine roof support reaches such a level that a first predetermined pressure limit within the leg is exceeded, fluid bleeds from the leg by passing into the port 15, through the passage 29 past the non-return valve device 30, through the bleed valve and out to atmosphere through a passage 32 in the member 27 and a hole 33 in the cap 28. When the pressures rises above this first predetermined limit the pressure is sufficient to move the valve member 25 off its seat 24 so that fluid can bleed past the valve member 25 through gaps 34.

It will be seen that the passage 29 consists of a relatively large diameter axial portion and a relatively small diameter radial portion. The radial portion comprises a flow restrictor which permits the passage of the relatively low quantities of pressurised fluid associated with bleeding as the rams of a mine roof support "give" during roof convergence. However the radial portion of passage 29 is resistant to the passage of greater quantities of fluid. In the event of a phenomenon such as a rock burst, the hydraulic legs of a mine roof support attempt to collapse quickly and therefore a relatively large quantity of fluid attempts to flow through the passage 29. This relatively large rate of flow is resisted by the narrow radial portion of passage 29 and so a significant pressure differential builds up across the head 21 of the poppet valve. The poppet valve is accordingly moved to the left as viewed in the FIGURE, lifting the tapered portion 20 off its seat and permitting the hydraulic fluid to be dumped rapidly through the relatively large bore port 19 and the dump port 13. Thus the rapid rate of retraction of the hydraulic leg can be accommodated.

Surges of hydraulic fluid may also occur at relatively low pressures, for example when the hydraulic legs of a support are being deliberately retracted and extended to move the support to a new position. With the subject of this embodiment these low pressure surges will not cause undesirable spurting of the dump stage. This is because the non-return valve device 30 traps within a pressure chamber 35 hydraulic fluid which is at a pressure substantially equal to the bleed pressure. This pressure is sufficient to maintain the poppet valve in its closed position during any fluid surges which take place at pressures less than the bleed pressure. In other words the frequent spurting that is associated with conventional devices is substantially eliminated.

The invention is not restricted to the details of the foregoing embodiment. For instance, although the valve has been designed for use with the hydraulic legs of mine roof supports it may also be used with a single hydraulic prop, with any other hydraulic ram which is required to yield in a two-stage manner, or indeed with any hydraulic path where two-stage pressure relief is required.

The valve device is self-charging and does not require any pre-pressurisation of an isolated pressure chamber or gas chamber.

I claim:

1. A valve device comprising:

a valve body defining an inlet port for connection to a pressurised fluid path to receive pressurised fluid at a pressure which varies through first and second predetermined values, said second value being higher than said first value;

a bleed valve arranged in said valve body for permitting said fluid to bleed from the valve body at a first rate when the pressure of the pressurised fluid exceeds said first value;

a dump valve arranged in said valve body in series with said bleed valve between said bleed valve and said inlet port for dumping said fluid from said valve body at a second rate substantially greater than said first rate when the pressure of said fluid exceeds said second value;

a bypass circuit connected to said inlet port and said bleed valve for directing pressurised fluid past said dump valve to said bleed valve without opening said dump valve when the pressure of said fluid lies between said first and second values, said bypass circuit having a non-return valve therein.

2. A valve device as claimed in claim 1, in which said dump valve has a valve member, and said bypass circuit passes through said valve member, said non-return valve being positioned in said valve member.

3. A valve device, comprising:

a valve body defining an inlet port for connection to a pressurised fluid path to receive pressurised fluid at a pressure which varies through first and second predetermined values, said second value being higher than said first value;

a bleed valve arranged in said valve body for permitting fluid to bleed from said valve body at a first rate when the pressure of the pressurised fluid exceeds said first value;

a dump valve arranged in said valve body in series with said bleed valve between said bleed valve and said inlet port for dumping said fluid from said valve body at a second rate substantially greater than said first rate when the pressure of said fluid exceeds said second value, said dump valve comprising a valve seat and a valve member, said valve member including first and second guiding portions, said first guiding portion being slidably received within a housing member and engageable with said valve seat, said second portion including a piston portion slidably received within a cylinder, said piston portion including a surface against which pressurised fluid acts to move said first guiding portion out of engagement with said valve seat for dumping said fluid; and a bypass circuit connected to said inlet port and said bleed valve for directing pressurised fluid past said dump valve to said bleed valve without disengaging said first portion from said seat when the pressure of said fluid lies between said first and second values, said bypass circuit having a non-return valve therein.

4. A hydraulic ram when connected to a valve device as claimed in claim 1.

5. A hydraulic ram as claimed in claim 4, in which said first rate causes the ram to yield at a rate of 2 to 3 mm per minute.

6. A hydraulic ram as claimed in claim 4, in which said second rate causes the ram to yield at a rate of 0.5 to 1.5 meters per second.

* * * * *